US005370084A

United States Patent [19]

Skowyra et al.

[11] Patent Number: 5,370,084

[45] Date of Patent: Dec. 6, 1994

[54] PANTLEG CIRCULATING FLUIDIZED BED BOILER AND COMBUSTION METHOD USING SAME

[75] Inventors: Richard S. Skowyra, Feeding Hills, Mass.; Bruce W. Wilhelm, Enfield, Conn.

[73] Assignee: Combustion Engineering, Inc., Windsor, Conn.

[21] Appl. No.: 249,806

[22] Filed: May 26, 1994

[51] Int. Cl.[5] ..... F22B 1/00

[52] U.S. Cl. ..... 122/4 D; 110/245; 422/145; 422/146

[58] Field of Search ..... 122/4 D; 110/245; 165/104.16; 422/145, 146

[56] References Cited

U.S. PATENT DOCUMENTS 4,716,856 1/1988 Beisswenger et al. ..... 122/4

4,817,543 4/1989 Beisswenger et al. ..... 122/4 D 5,215,042 6/1993 Beisswenger et al. ..... 122/4 D

*Primary Examiner*—Edward G. Favors

*Attorney, Agent, or Firm*—Chilton, Alix & Van Kirk

[57] ABSTRACT

A combustion subsystem with a circulating fluid bed boiler (12) having a pantleg configuration. The boiler includes front (22) and back (24) walls with external fluid bed heat exchangers (48) integral therewith. In addition to the conventional fuel inlets (54) which provide for entry of fuel into the side walls of the boiler through conduits connected to the seal pots (36) of solids recycle cyclones (30), supplemental fuel inlets (63, 66, 70, 72) are provided on the front and back wails of the boiler through the fluid bed heat exchangers or between adjacent fluid bed heat exchangers. The invention improves combustion efficiency in large boilers by reducing the theoretical mixing length within the boiler.

20 Claims, 4 Drawing Sheets

PANTLEG CIRCULATING FLUIDIZED BED BOILER AND COMBUSTION METHOD USING SAME

BACKGROUND OF THE INVENTION

The present invention relates generally to fluidized bed boilers, and more particularly to pantleg circulating fluidized bed boilers having multiple fuel feed points.

Fluidized bed reactors are known for use in combustion and non-combustion reactor systems. One of the primary advantages of using fluidized bed reactors as contrasted to fixed bed reactors in combustion reactor systems is that the fluidized bed reactors burn coal efficiently at a relatively low temperature, thereby resulting in minimal nitrogen-oxide production. Furthermore, the high thermal inertia of the bed mass provides for good performance when firing low-volatile fuels such as anthracite, anthracite culm, and petroleum coke. A sorbent material can be added to the reactor in order to control sulfur dioxide emissions. Therefore, it is not necessary to include a stack-gas $SO_2$ scrubber. The sulfur sorbent also can react with other fuel constituents such as vanadium, reducing down stream corrosion potential.

The two standard types of fluidized bed reactors are bubbling fluidized beds and circulating fluidized beds. In a bubbling fluidized bed (BFB), which is characterized by relatively slow gas velocity and coarse bed-particle size, the conduction/convection heat transfer is to furnace wall tubes and other heating surfaces that may be immersed in the bed. Furthermore, radiation heat transfer occurs above the active bed. In a circulating fluid bed (CFB), which is characterized by high gas velocities and a finer bed-particle size, the bulk of conduction/convection heat transfer is to the combustor wall tubes.

It is known to design a combustion system which uses a pantleg CFB boiler in conjunction with a pair of external fluid bed heat exchangers (FBHEs). When a compact system design is desired, integral FBHEs such as those described in U.S. Pat. No. 4,716,856, the contents of which are incorporated herein by reference, can be used. In a conventional system, one FBHE extends along the front wall of the CFB boiler and the other extends along the rear wall of the CFB boiler at the lower end of the boiler.

In the conventional configuration of a pantleg CFB boiler equipped with integral, external FBHEs, there is a limitation as to the number of gravity fuel feed points which are available. Because the gravity fuel feed points should be approximately six feet above the combustor grate, the location of the FBHEs along the front and rear walls of the boiler precludes the use of fuel feed inlets on the front and rear walls. Typically, the fuel is fed into cyclone seal pots which provide for entry of the fuel along with the recycled solids through inlet ports on the side walls of the boiler. A conventional system of this type includes four seal pots, and therefore a conventional pantleg CFB boiler has only four fuel feed inlets. For small boilers, this number of feed points is sufficient. However, for larger boilers, four fuel feed points may be insufficient to produce the result of high combustion efficiency. In addition to using an unnecessarily large amount of fuel, the use of an insufficient number of fuel feed points will likely result in the generation of undesirable emissions, at least when fuel having a low reactivity is used. It would be advantageous to be able to include additional fuel feed points in large pantleg boilers of this type in order to reduce the theoretical mixing length of the fuel within the boiler.

SUMMARY OF THE INVENTION

An object of the invention is to provide a pantleg CFB boiler having improved combustion efficiency.

Another object of the invention is to provide a pantleg CFB boiler having a greater number of fuel feed points than a conventional pantleg CFB boiler.

A further object of the invention is to provide a CFB boiler having a reduced fuel mixing length.

A further object of the invention is to provide a method for optimizing combustion in a large pantleg CFB boiler.

Other objects will be in part obvious and in part pointed out more in detail hereinafter.

The invention in a preferred form is a combustion subsystem comprising a circulating fluid bed boiler having a pantleg configuration. The boiler includes a pair of vertical side walls, a pair of inner slant walls, a front wall with a lower end portion having first external fluid bed heat exchange means integral therewith, and a back wall with a lower end portion having second fluid bed heat exchange means integral therewith. The subsystem further includes a plurality of fuel inlets, at least one of which is a supplemental fuel inlet which is configured to provide for entry of fuel into the boiler through one of the front wall, the back wall, and the inner slant walls of the boiler at a height below the roofs of the integral heat exchange means.

In one particularly preferred embodiment of the invention, at least one of the first and second heat exchange means comprises two fluid bed heat exchangers which are integral with the same wall and are horizontally spaced from each other. A supplemental fuel inlet is formed on the boiler wall between the two fluid bed heat exchangers.

In another particularly preferred form of the invention, one or more supplemental fuel inlets are formed on the top wall of one or more heat exchangers. The fuel then enters the boiler through the wall which is integral with the heat exchanger. In this configuration, fuel enters the heat exchanger at a location other than within a tube assembly. For example, in a heat exchanger which includes a plurality of tube assemblies, the fuel inlet can be positioned between adjacent tube assemblies.

In yet another particularly preferred embodiment of the invention, the combustion subsystem includes a plurality of recycle cyclones with seal pots, and at least one of the supplemental fuel inlets is formed in a conduit from a seal pot into the heat exchange means. In this configuration, a conventional fuel inlet from the outlet end of a seal pot directly into a solids conduit which feeds fuel into a side wall of the boiler generally also is included.

In yet another preferred form of the invention, the supplemental fuel inlets, which preferably are pneumatically fed, are formed on the inner slant walls of the boiler.

Another preferred form of the invention is a method for reducing the mixing length for fuel in a circulating fluid bed boiler having a pantleg configuration, opposite vertical side walls with fuel inlets, opposite inner slant walls, and opposite front and back walls. The method comprises disposing integral external fluid bed heat exchangers, each of which has a roof, on the front and back walls of the boiler, and adding at least one supplemental fuel inlet to the subsystem at a location which provides for entry of fuel through at least one of the front and back walls of the boiler at a height below the roofs of the integral external fluid bed heat exchangers.

The supplemental fuel inlets according to the invention preferably are gravity-fed or pneumatically fed. However, fuel can also be fed through mechanical supplemental fuel inlets.

The invention accordingly comprises the several steps and the relation of one or more of such steps with respect to each of the others and the article possessing the features, properties, and the relation of elements described in the following detailed disclosure.

DETAILED DESCRIPTION OF THE INVENTION

Figure 2:
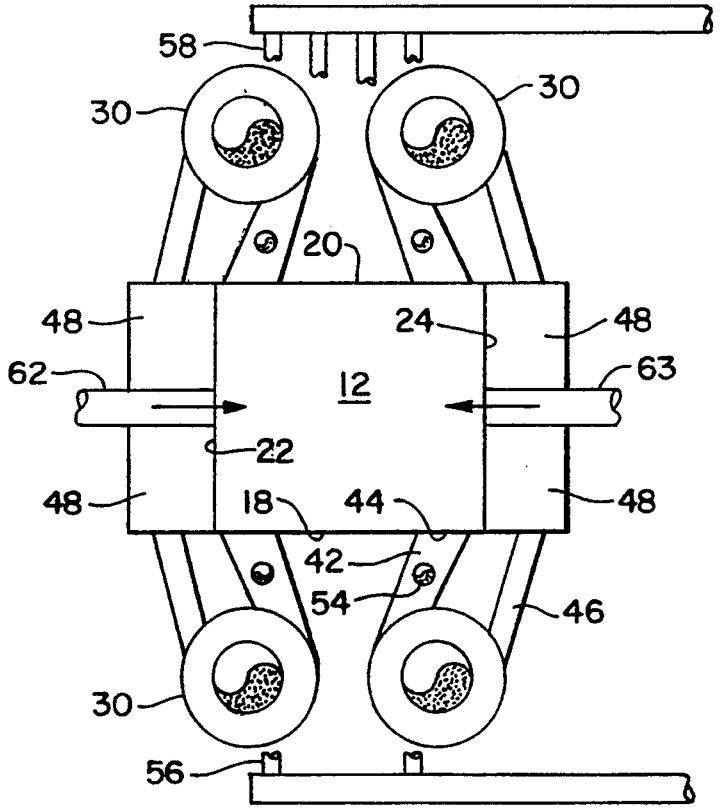
FIG. 2 is a schematic top view of the subsystem of FIG. 1, also showing sectional views of four solid recycle cyclones which are connected to the boiler.
Figure 1:
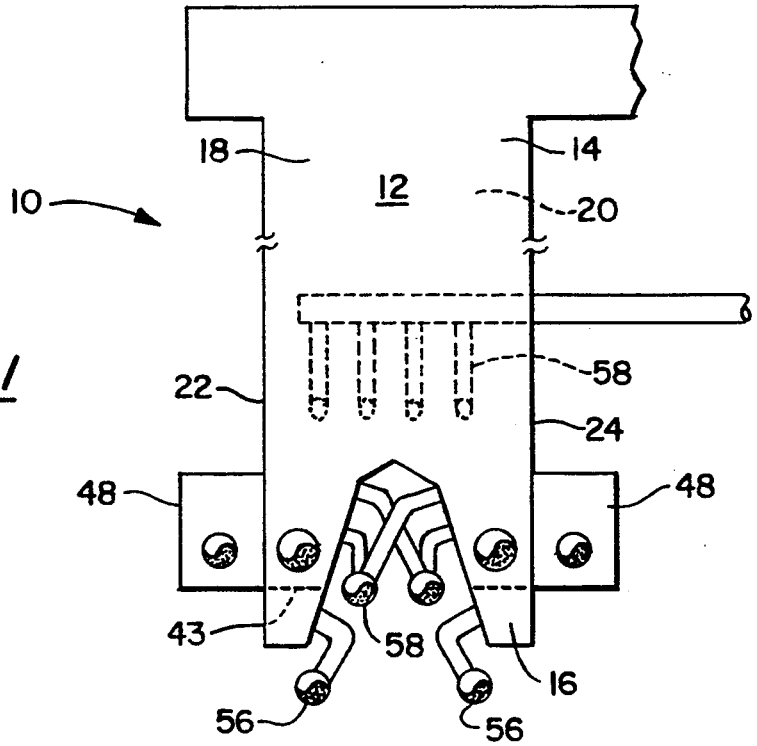
FIG. 1 is a schematic side elevational view of a combustion subsystem having a pantleg CFB boiler with fluidized bed heat exchangers along the front and back walls of the boiler in accordance with the present invention.
Figure 3:
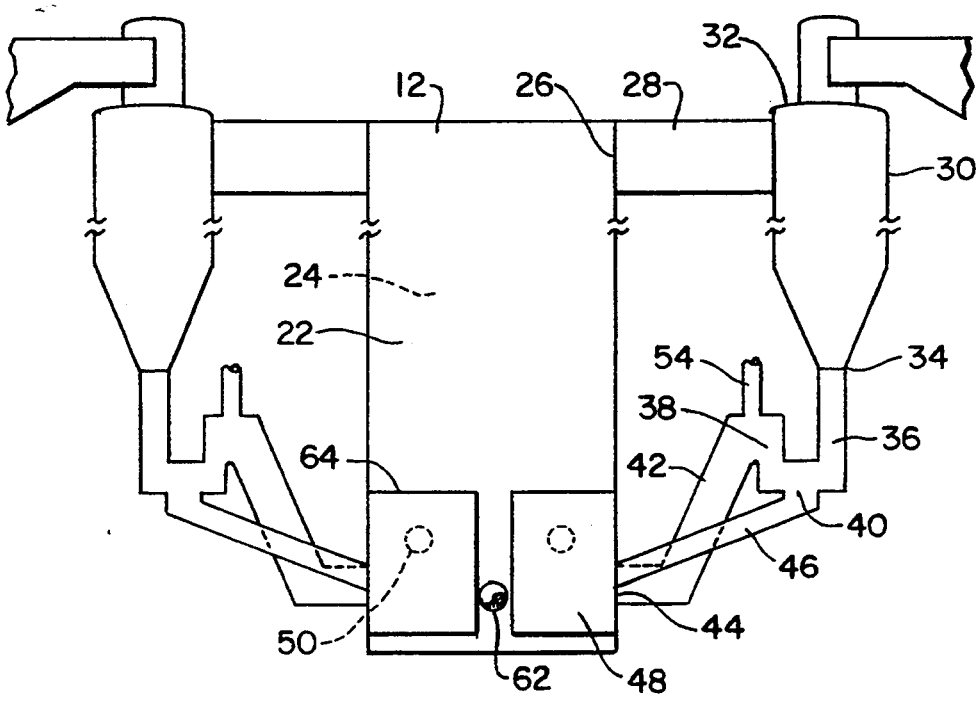
FIG. 3 is a schematic front elevational view of the subsystem shown in FIG. 2.

Referring to the drawings, and particularly to FIGS. 1–3, a combustion subsystem is generally designated as 10. The subsystem includes a pantleg boiler 12 with an upper end portion 14 and a lower end portion 16. The boiler 12 is rectangular in outer section and has a pair of opposite side walls 18, 20, a front wall 22 and a back wall 24. Four flue gas-solids outlets 26, two of which are shown in FIG. 3, are connected to the upper end portion 14 of the boiler 12 for removing a mixture of flue gas and entrained solids from the boiler 12. Each outlet 26 is connected to a separate conduit 28 which provides for conveyance of the flue gas and solids to a separate cyclone 30. The flue gas is removed from the top 32 of each of the four cyclones 30. The solids exit through the bottom 34 of each cyclone 30 into a seal pot 36. The seal pots 36 each have two outlets 38, 40. Outlet 38, which is at the end of the seal pot opposite to the cyclone 30, is connected to a conduit 42 which returns the solids directly to the boiler 12 in a conventional manner through boiler inlet 44 which is positioned about 4–10 feet, preferably 5–8 feet, and more preferably about 6 feet above the combustion grate 43. Outlet 40 is connected to a conduit 46 which is connected to a central portion of the seal pot 36 and transfers the solids in a conventional manner to a FBHE 48 which is integral with the front wall 22 or back wall 24 of the boiler 12. Depending on process conditions, a substantial amount of solids may be sent through outlet 40, or on the other hand, flow through this outlet may be controlled to be very small if it is preferable to send the solids directly into boiler 12 through inlet 44. Each FBHE 48 has at least one solids outlet 50, through which solids re-enter the boiler 12. Thus, a first portion of the recycled solids returns directly to the boiler 12 through boiler inlet 44, while a second portion passes through the FBHE 48 prior to returning to the boiler 12 through solids outlet 50.

Fuel is fed to the boiler 12 through fuel inlet 54 which is formed on conduit 42. The fuel may or may not be mixed with recycle solids and enters the boiler 12 through boiler inlet 44. Typically, fuel is fed into fuel inlets 54 by gravity. However, pneumatic or mechanical feeding also can be used. In a pneumatic feed system, fuel is delivered using air or flue gas in a dense or dilute pneumatic transport system using commercially available equipment. A pneumatic fuel feed system is somewhat more flexible than a gravity feed system because fuel pipes can be routed around obstruction to satisfy preferred point locations and geometry.

Primary combustion air is fed to the boiler 12 through one or more primary air ducts 56, two of which are shown in FIG. 1, which feed air into the boiler 12 from the pantlegs, and one or more secondary air ducts 58, six of which are shown in FIG. 1, which feed air into the boiler 12 on the inner slant walls, front wall and back wall of the combustor in a conventional manner. Sorbent can be fed thru any combustor wall or into a seal pot, if desired.

The two heat exchangers 48 along a single wall are horizontally spaced from each other. Alternately, depending on equipment sizes, the two heat exchangers could be vertically spaced, each extending along substantially all of the horizontal length of the wall. One important way in which this configuration differs from a conventional subsystem is that a conventional subsystem has only a single FBHE extending along substantially the entire length of the front wall of the boiler and a single FBHE extending along substantially the entire length of the back wall.

In accordance with the embodiment shown in FIGS. 1–3, the two FBHEs 48 along the front wall 22 of the boiler 12 are separated from each other by a distance sufficient to provide for the inclusion of a supplemental gravity-fed fuel inlet 62 therebetween which preferably is at a height of approximately 4–10, preferably 5–8, and more preferably about 6 feet above the combustor grate 43 and is below the height of a top wall 64 of the FBHEs 48. Back wall 24 has a similar configuration, i.e., the FBHEs 48 are separated by a distance appropriate to include a supplemental gravity-fed fuel inlet 63 therebetween which preferably is about six feet above the combustor grate 43 and is below the height of the top wall 64 of the FBHEs 48. As an alternative to gravity feeding through inlets 62 and 63, fuel can be fed pneumatically or mechanically through inlet 63. If pneumatic feeding is used, it may also be advantageous to pneumatically feed the fuel which enters the boiler through fuel inlets 54.

The boiler 12 which is shown in FIGS. 1–3 typically is a 150–650 MW unit. For example, in a 250 MW unit, if only the conventional four fuel feed points were used, the fuel must traverse approximately 23 feet to reach the center of the unit. However, by including the two supplemental fuel inlets 62, 63 on the front and back walls 22, 24, respectively, each of which provides for introduction of about 1/6 of the fuel, the theoretical mixing length in the boiler is reduced to about 12 feet. It is also possible for fuel inlets to input fuel at different rates.

Figure 4:
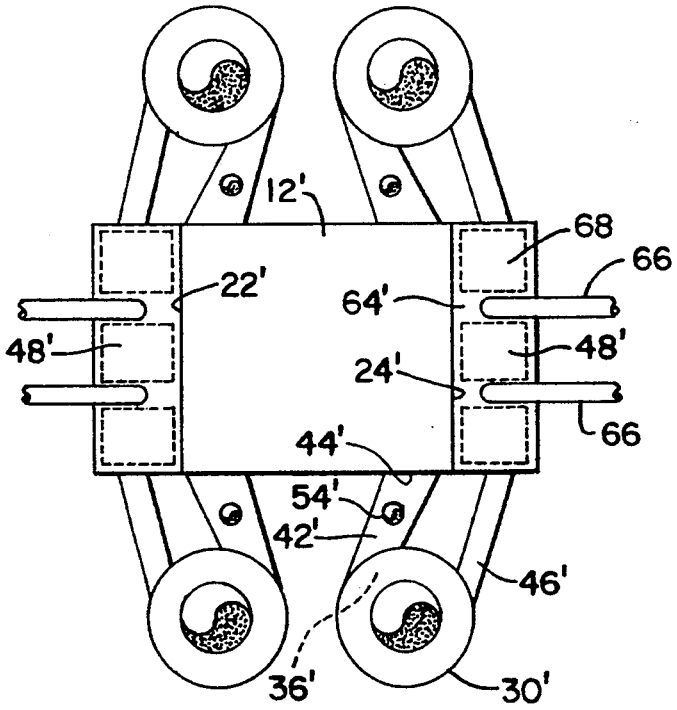
FIG. 4 is a schematic top view of a combustion subsystem having a pantleg CFB boiler according to a second embodiment of the invention, showing sectional views of four solid recycle cyclones connected to the boiler.

FIG. 4 shows a second embodiment of the invention. As in the first embodiment, four fuel inlets 54' receive fuel which is transferred to the boiler 12' through boiler inlets 44' by way of four conduits 42' connected to the outlet side of four conventional seal pots 36' corresponding to cyclones 30'. The primary and secondary air inlets (not shown) are identical to those of the embodiment of FIG. 1. Solids conduits 46' allow for passage of solids from the cyclones 30' to FBHEs 48'. The solids subsequently pass through FBHE solids outlets (not shown) which are similar to solids outlets 50 shown in FIG. 3 and which enter the boiler 12'. In this second embodiment, there is only a single FBHE 48' along the front wall 22' and a single FBHE 48' along the back wall 24' of the boiler 12', each FBHE 48' having three tube assemblies 68, shown in phantom. Each of the FBHEs 48' has a top wall 64' with a pair of longitudinally spaced supplemental gravity-fed fuel inlets 66 formed therein. The inlets 66 provide for the feeding of additional fuel into the boiler 12' through front and back walls 22', 24'. The supplemental fuel inlets 66 provide for entry of fuel into a part of the FBHEs 48' which does not include a tube assembly, such as a space between adjacent tube assemblies 68, or an empty compartment (not shown). In the FBHEs 48' the fuel either mixes with solids which have been recycled from the boiler 12, through cyclones 30' and seal pots 36', and a fuel-solids mixture enters the boiler 12' through solids outlets from the FBHEs 48', or the fuel is kept in a separate conduit within FBHE 48 and enters boiler 12' through a separate FBHE outlet located adjacent to an FBHE solids outlet. This arrangement of four supplemental FBHE fuel inlets 66 further reduces the theoretical mixing length for fuel in the boiler 12.

Figure 5:
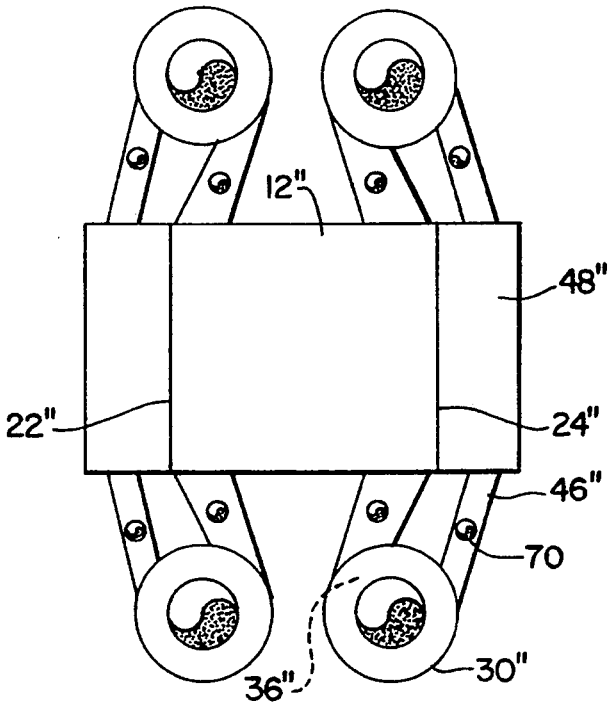
FIG. 5 is a schematic top view of a combustion subsystem having a pantleg CFB boiler according to a third embodiment of the present invention, showing sectional views of four solid recycle cyclones connected to the boiler.
Figure 6:
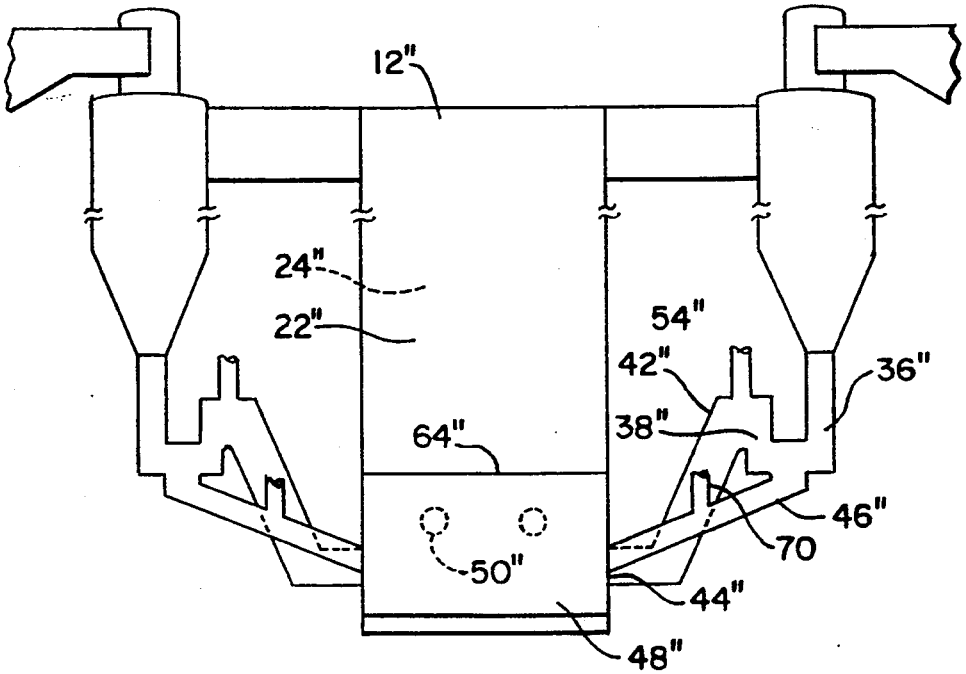
FIG. 6 is a schematic front elevational view of the embodiment shown in FIG. 5.

A third embodiment of the invention is shown in FIGS. 5–6. In this embodiment, boiler 12" has a single FBHE 48" on each of the front and back walls 22", 24", and two cyclones 30" with seal pots 36" connected to each FBHE 48" and to the boiler 12" A conventional fuel inlet 54" is provided in each solids conduit 42". Fuel is therefore mixed with the solids in conduit 42" and enters boiler 12" Furthermore, a supplemental fuel inlet 70 is provided in each conduit 46" which provides that fuel enters the FBHEs 48" with the solids and is then transferred with the solids to boiler 12". As with the embodiment shown in FIG. 3, fuel which enters the FBHE 48" enters a portion of the FBHE 48" such that it is between tube assemblies. Thus, this embodiment provides for the introduction of four supplemental fuel inlets as compared to a conventional subsystem.

Figure 7:
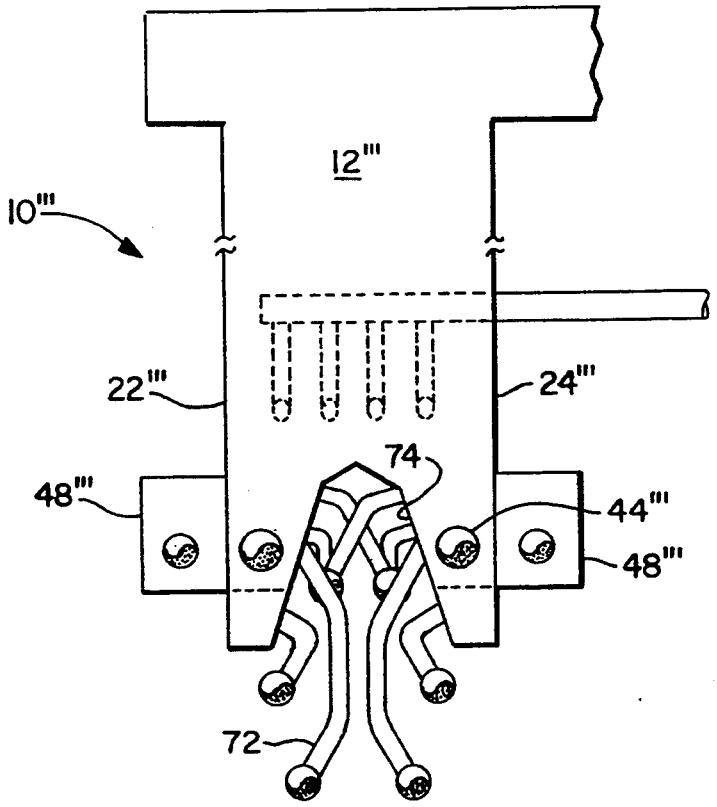
FIG. 7 is a schematic side elevational view of a combustion subsystem having a pantleg CFB boiler with fluidized bed heat exchangers along the front and back walls of the boiler in accordance with a fourth embodiment of the present invention.

A fourth embodiment of the invention is shown in FIG. 7. Subsystem 10''' includes a boiler 12''' which has a single FBHE 48''' on each of the front and back walls 22''', 24''', respectively. Two or more pneumatically fed supplemental fuel inlets 72 enter the boiler 12''' along inner slant walls 74 of the boiler 12'''. The inlets 72 are positioned to provide a minimal mixing length for the fuel and preferably are at a height comparable to the conventional boiler inlets 44''' from seal pots (not shown) which receive fuel through conventional gravity-fed fuel inlets.

In the preferred embodiments of the invention, all of the fuel inlets are either gravity-fed or pneumatically fed. However, the invention also is applicable to other types of fuel inlets, including mechanical fuel delivery systems, such as screw feeders and hydraulic systems.

As mentioned above, the subsystem of the invention is effective for reducing the mixing length for fuel in a pantleg CFB boiler. While it is preferable to add two or four additional fuel inlets, the exact number of additional inlets to be added will depend upon specific boiler size and design. Thus, various combinations of the embodiments which are shown could be made in order to add one or more additional fuel inlets to a subsystem. Furthermore, as a specific example of a variation of the embodiment shown in FIGS. 1–3, the FBHEs on each of the front and back walls of a conventional system could be divided into more than two smaller FBHEs, thereby providing space for more supplementary fuel inlets. As will be apparent to persons skilled in the art, various other modifications and adaptations of the structure above described will become readily apparent without departure from the spirit and scope of the invention, the scope of which is defined in the appended claims.

What is claimed is:

1. A combustion subsystem comprising a circulating fluid bed boiler having a pantleg configuration, the boiler including a pair of vertical side walls, a front wall with a lower end portion having first external fluid bed heat exchange means integral therewith, a back wall with a lower end portion having second fluid bed heat exchange means integral therewith, and first and second inner slant walls, the first and second heat exchange means each having a roof, the subsystem further including a plurality of fuel inlets, at least one of which constitutes a supplemental fuel inlet which is configured to provide for entry of fuel into the boiler through one of the front wall, the back wall, and the first and second inner slant walls at a height below the roofs of the integral heat exchange means.

2. A subsystem according to claim 1, wherein at least one of the first and second heat exchange means comprises two fluid bed heat exchangers which are integral with the same wall and are horizontally spaced from each other, and the supplemental fuel inlet is formed on the boiler wall between the two fluid bed heat exchangers.

3. A subsystem according to claim 1, wherein at least one of the first and second heat exchange means comprises a fluid bed heat exchanger with a top wall, and the supplemental fuel inlet is formed on the top wall and provides for entry of fuel into the boiler through the boiler wall with which the heat exchange means is integral.

4. A subsystem according to claim 3, wherein the fluid bed heat exchanger includes at least one tube assembly and the supplemental fuel inlet is configured to enter a portion of the fluid bed heat exchanger other than the tube assembly.

5. A subsystem according to claim 1, further including a solids recycle cyclone with a seal pot which is connected to one of the fluid bed heat exchange means by a conduit, the supplemental fuel inlet being formed in the conduit and providing for entry of fuel into the boiler through the boiler wall with which the heat exchange means is integral.

6. A subsystem according to claim 5, wherein the heat exchange means is a heat exchanger with at least one tube assembly and the conduit is configured to enter a portion of the heat exchanger other than the tube assembly.

7. A subsystem according to claim 1, wherein the supplemental fuel inlet is gravity-fed.

8. A subsystem according to claim 1, wherein the supplemental fuel inlet is pneumatically fed.

9. A subsystem according to claim 8, wherein the supplemental fuel inlet is formed on one of the first and second inner slant walls of the boiler.

10. A subsystem according to claim 9, wherein the supplemental fuel inlet is pneumatically fed.

11. A subsystem according to claim 2, wherein all of the plurality of fuel inlets are pneumatically fed.

12. In a combustion subsystem having a circulating fluid bed boiler with a pantleg configuration, the boiler including opposite vertical side walls, opposite inner slant walls, and opposite from and back walls with lower end portions having integral external heat exchangers, each heat exchanger having a roof and a solids outlet, the subsystem further including a plurality of solids recycle cyclones with seal pots for recycling solids to the boiler, each seal pot including a conduit into a side wall of the boiler and a fuel inlet formed in the conduit to provide for entry of fuel through the side wall of the boiler, the improvement wherein the subsystem further includes at least one supplemental fuel inlet which is configured to provide for entry of fuel through one of the front wall, the back wall, and the inner slant walls at a height below the roofs of the integral heat exchangers.

13. A method of reducing the mixing length for fuel in a circulating fluid bed boiler subsystem having a pantleg configuration, opposite vertical side walls with fuel inlets, opposite inner slant walls, and opposite front and back walls, the method comprising disposing integral external fluid bed heat exchangers, each of which has a roof, on the front and back walls of the boiler, and adding at least one supplemental fuel inlet to the subsystem at a location which provides for entry of fuel through at least one of the front wall, the back wall and the inner slant walls at a height below the roofs of the integral external fluid bed heat exchangers.

14. A method according to claim 13, wherein the step of disposing comprises positioning two separate integral external fluid bed heat exchangers on at least one of the front and back walls of the boiler and the step of adding comprises positioning the supplemental fuel inlet between the two separate integral external fluid bed heat exchangers.

15. A method according to claim 13, wherein the step of adding comprises forming the supplemental fuel inlet in the roof of an integral external fluid bed heat exchanger.

16. A method according to claim 13, wherein the subsystem includes a seal pot having a first outlet connected to the boiler by a first conduit and a second outlet connected to a fluid bed heat exchanger by a second conduit, and the step of adding comprises including a supplemental fuel inlet in the second conduit.

17. A method according to claim 13, wherein the supplemental fuel inlet is gravity-fed.

18. A method according to claim 13, wherein the step of adding comprises including a supplemental fuel inlet on an inner slant wall.

19. A method according to claim 18, wherein the supplemental fuel inlet is pneumatically fed.

20. A method according to claim 14, wherein the supplemental fuel inlet is pneumatically fed.

* * * * *

UNITED STATES PATENT AND TRADEMARK OFFICE

CERTIFICATE OF CORRECTION

PATENT NO. : 5,370,084

DATED : December 6, 1994

INVENTOR(S) : Richard S. Skowyra et al

It is certified that error appears in the above-indentified patent and that said Letters Patent is hereby corrected as shown below:

Claim 12, column 7, line 22, change "from" to --front--.

Signed and Sealed this

Second Day of May, 1995

Bruce Lehman

*Attest:*

BRUCE LEHMAN

*Attesting Officer*

*Commissioner of Patents and Trademarks*